US011193226B2

(12) United States Patent
Jung et al.

(10) Patent No.: US 11,193,226 B2
(45) Date of Patent: Dec. 7, 2021

(54) LAUNDRY TREATMENT APPARATUS AND CONTROL METHOD THEREOF

(71) Applicant: LG Electronics Inc., Seoul (KR)

(72) Inventors: Jongseok Jung, Seoul (KR); Seongmin Jang, Seoul (KR); Bokyung Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 250 days.

(21) Appl. No.: 16/234,088

(22) Filed: Dec. 27, 2018

(65) Prior Publication Data

US 2019/0194861 A1 Jun. 27, 2019

(30) Foreign Application Priority Data

Dec. 27, 2017 (KR) ..... 10-2017-0181374

(51) Int. Cl.

| | |
|---|---|
| ***D06F 39/04*** | (2006.01) |
| ***D06F 33/44*** | (2020.01) |
| ***D06F 37/38*** | (2006.01) |
| ***D06F 23/04*** | (2006.01) |
| *D06F 39/08* | (2006.01) |
| *D06F 37/30* | (2020.01) |

(Continued)

(52) U.S. Cl.

CPC ..... *D06F 33/44* (2020.02); *D06F 23/04* (2013.01); *D06F 37/38* (2013.01); *D06F 34/28* (2020.02); *D06F 37/304* (2013.01); *D06F 39/087* (2013.01); *D06F 39/088* (2013.01); *D06F 2103/16* (2020.02); *D06F 2103/18* (2020.02); *D06F 2105/10* (2020.02); *D06F 2105/56* (2020.02)

(58) Field of Classification Search

None

See application file for complete search history.

(56) References Cited

U.S. PATENT DOCUMENTS

2007/0283510 A1 12/2007 Jeong
2017/0226679 A1* 8/2017 De Bernardo ..... D06F 35/005

FOREIGN PATENT DOCUMENTS

CN 102691196 9/2012
CN 105705696 6/2016

(Continued)

OTHER PUBLICATIONS

WO 2015/059825 machine translation, Mamiya Harou, Washing Machine (Year: 2015).*

(Continued)

*Primary Examiner* — Cristi J Tate-Sims

(74) *Attorney, Agent, or Firm* — Fish & Richardson P.C.

(57) ABSTRACT

A laundry treatment apparatus includes a tub that stores wash water; a drum rotatably disposed in the tub; a heater that heats wash water in the tub; a temperature sensor that senses a temperature of wash water; an output unit that displays at least one operation setting of the laundry treatment apparatus; and a controller configured to: determine an initial operation time based on the at least one operation setting; output the initial operation time through the output unit; determine an operation time based on (i) the temperature of wash water sensed by the temperature sensor during a supply of water to the tub and (ii) a level of wash water supplied to the tub; and output the operation time through the output unit.

13 Claims, 9 Drawing Sheets

(51) Int. Cl.

| | |
|---|---|
| *D06F 103/16* | (2020.01) |
| *D06F 103/18* | (2020.01) |
| *D06F 105/10* | (2020.01) |
| *D06F 105/56* | (2020.01) |
| *D06F 34/28* | (2020.01) |

(56) References Cited

FOREIGN PATENT DOCUMENTS

| | | |
|---|---|---|
| CN | 105734915 | 7/2016 |
| CN | 106436148 | 2/2017 |
| KR | 1020010084246 | 9/2001 |
| WO | WO2015059825 | 4/2015 |

OTHER PUBLICATIONS

Chinese Office Action in Chinese Appln. No. 201811611972.9, dated Oct. 30, 2020, 15 pages (with English translation).
Extended European Search Report in European Application No. 18215829.5, dated Apr. 18, 2019, 7 pages.

* cited by examiner

LAUNDRY TREATMENT APPARATUS AND CONTROL METHOD THEREOF

CROSS-REFERENCE TO RELATED APPLICATION

This application claims the priority benefit of Korean Patent Application No. 10-2017-0181374, filed on Dec. 27, 2017 in the Korean Intellectual Property Office, the disclosure of which is incorporated herein by reference.

FIELD

The present disclosure relates to a laundry treatment apparatus and a control method thereof.

BACKGROUND

In general, the term "laundry treatment apparatus" commonly designates various kinds of apparatuses for removing contaminants from clothing, bedding, etc. (hereinafter, referred to as 'laundry') using a chemical decomposition action of water and detergent and a physical action, such as friction, between water and laundry. The laundry treatment apparatus is basically configured to have a structure in which a drum for receiving laundry is rotatably installed. The laundry treatment apparatus may be classified as a front loading type laundry treatment apparatus, into which laundry is introduced through an introduction port provided in the front surface thereof, and a top loading type laundry treatment apparatus, into which laundry is introduced through an introduction port provided in the upper surface thereof.

The top loading type laundry treatment apparatus includes a cabinet, a tub disposed in the cabinet, the tub being provided in the upper surface thereof with an introduction port, a drum rotatably disposed in the tub, and a door for opening and closing the introduction port. In addition, a door may be disposed at the top of the tub so as to be connected to the tub in order to open and close the open top of the tub, and a top cover may be disposed at the remaining portion of the top of the tub, excluding the portion of the top of the tub at which the door is disposed, in order to cover the tub.

A laundry treatment apparatus performs washing, rinsing, and spin drying (drying) according to input operation settings in order to remove contaminants from laundry.

The laundry treatment apparatus sets the temperature of water as well as a washing course. In the case in which there is a difference between the temperature of the wash water introduced into the laundry treatment apparatus and a set temperature, the laundry treatment apparatus may heat the wash water such that washing is performed at the set temperature.

Korean Patent Application Publication No. 1991-0018530 discloses a washing method of a boiling washing machine, wherein wash water is heated using a heater in order to perform soak washing.

However, the total operation time may be changed due to heating of the wash water.

When the wash water is heated, the time required until the temperature of the wash water reaches a predetermined temperature may vary depending on the level of the wash water. Furthermore, much more time than a basically set time may be taken. As a result, washing may not be completed even after an expected operation time has elapsed.

SUMMARY

Therefore, the present invention has been made in view of the above problems, and it is an object of the present invention to provide a laundry treatment apparatus that is capable of resetting and displaying an operation time depending on whether it is necessary to heat wash water and a control method thereof.

In accordance with an aspect of the present invention, the above and other objects can be accomplished by the provision of a laundry treatment apparatus including a tub having therein a space for storing wash water, a drum rotatably provided in the tub, a heater for heating the wash water in the tub, a temperature sensor for sensing the temperature of the wash water, a manipulation unit for allowing operation settings to be input, an output unit for displaying the operation settings and the operation state thereof, and a controller for primarily calculating an operation time based on the operation settings and outputting the calculated operation time through the output unit and for recalculating the operation time based on the water temperature sensed by the temperature sensor during the supply of water and outputting the recalculated operation time through the output unit.

In accordance with another aspect of the present invention, there is provided a control method of a laundry treatment apparatus, the control method including inputting operation settings, calculating an operation time based on a washing course according to the operation settings and primarily outputting the calculated operation time, sensing the temperature of wash water supplied to a tub, recalculating the operation time based on the water temperature, and secondarily outputting the recalculated operation time.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Advantages, features and methods for achieving those of embodiments may become apparent upon referring to embodiments described later in detail together with the attached drawings. However, embodiments are not limited to the embodiments disclosed hereinafter, but may be embodied in different modes. The embodiments are provided for perfection of disclosure and informing a scope to persons skilled in this field of art. The same reference numbers may refer to the same elements throughout the specification. In addition, each unit including a controller may be constituted by at least one processor.

Hereinafter, embodiments of a laundry treatment apparatus according to the present invention will be described with reference to the accompanying drawings.

<First Laundry Treatment Apparatus and Second Laundry Treatment Apparatus>

Figure 1:
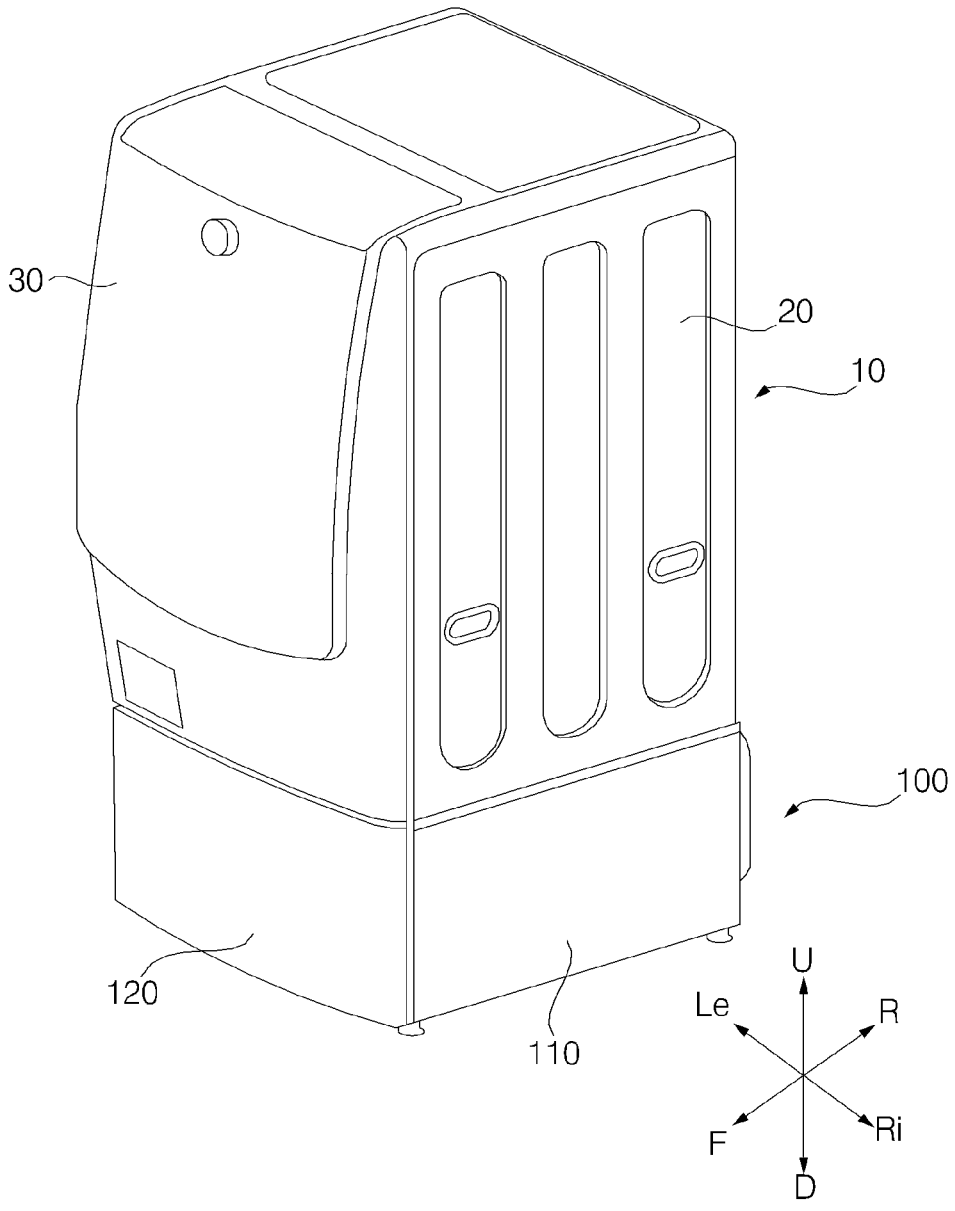
FIG. 1 is a perspective view of a laundry treatment apparatus according to an embodiment of the present invention.

FIG. 1 is a perspective view of a laundry treatment apparatus according to an embodiment of the present invention.

The laundry treatment apparatus according to the present invention, which is an apparatus that washes, rinses, spin-dries, or dries laundry, may be configured to include only a first laundry treatment apparatus 100 or to include both a first laundry treatment apparatus 100 and a second laundry treatment apparatus 10 disposed on the first laundry treatment apparatus 100.

Referring to FIG. 1, the laundry treatment apparatus according to this embodiment may be configured such that the second laundry treatment apparatus 10 is disposed on the first laundry treatment apparatus 100. However, this is merely an example. Alternatively, only the first laundry treatment apparatus 100 may be independently provided.

The second laundry treatment apparatus 10 may include a second cabinet 20, which defines the external appearance thereof, and a second door 30 for opening and closing the front of the second cabinet 20. In addition, the second laundry treatment apparatus 10 may further include a second tub (not shown) disposed in the second cabinet 20 for defining a space for storing wash water, a second drum (not shown) rotatably disposed in the second tub for defining a space for storing laundry, a second water supply unit (not shown) for supplying wash water to the second tub, and a second drainage unit (not shown) for discharging the wash water stored in the second tub out of the second cabinet 20.

<First Laundry Treatment Apparatus>

Figure 2:
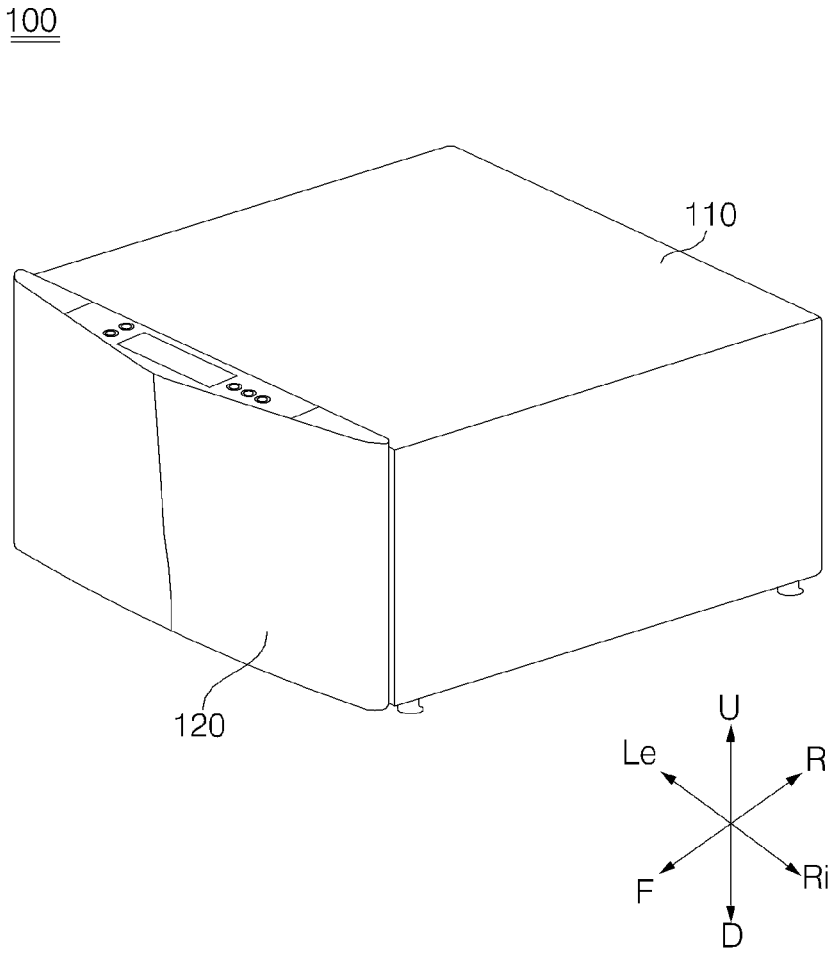
FIG. 2 is a perspective view of a first laundry treatment apparatus according to an embodiment of the present invention.
Figure 3:
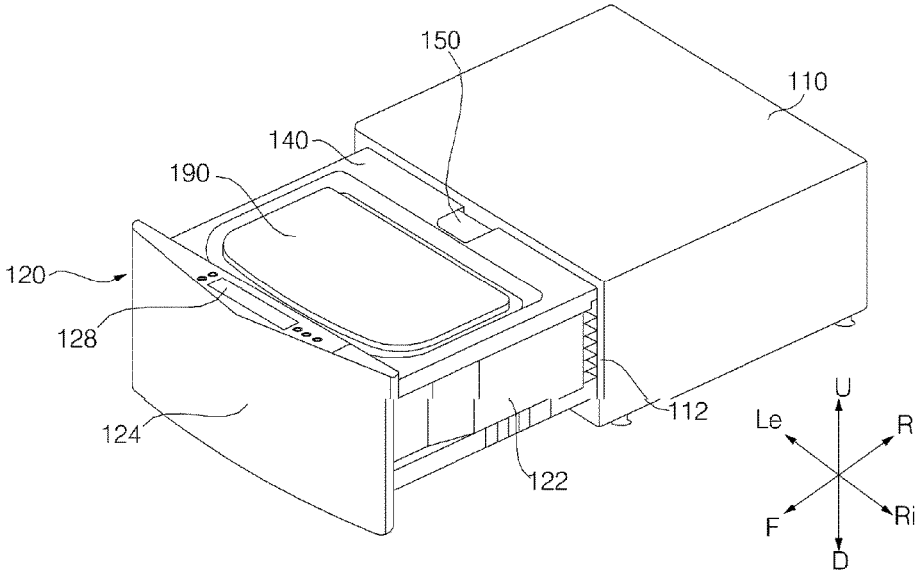
FIG. 3 is a perspective view showing the state in which a drawer of the first laundry treatment apparatus according to the embodiment of the present invention is withdrawn.
Figure 4:
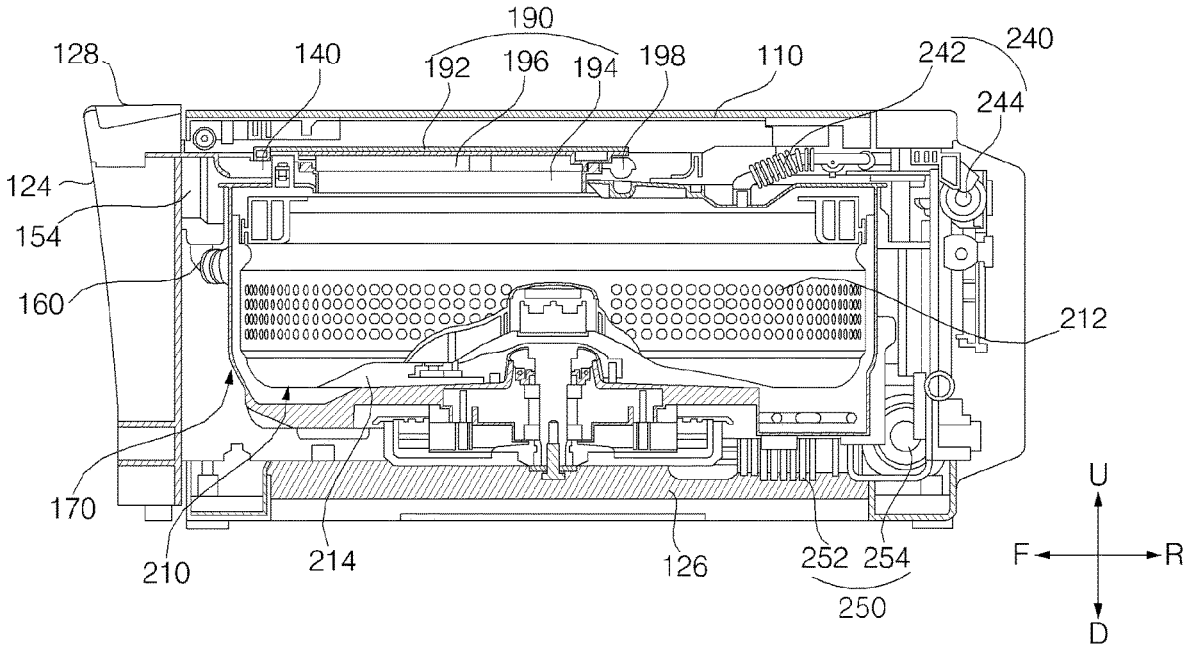
FIG. 4 is a sectional view of the first laundry treatment apparatus according to the embodiment of the present invention.
Figure 5:
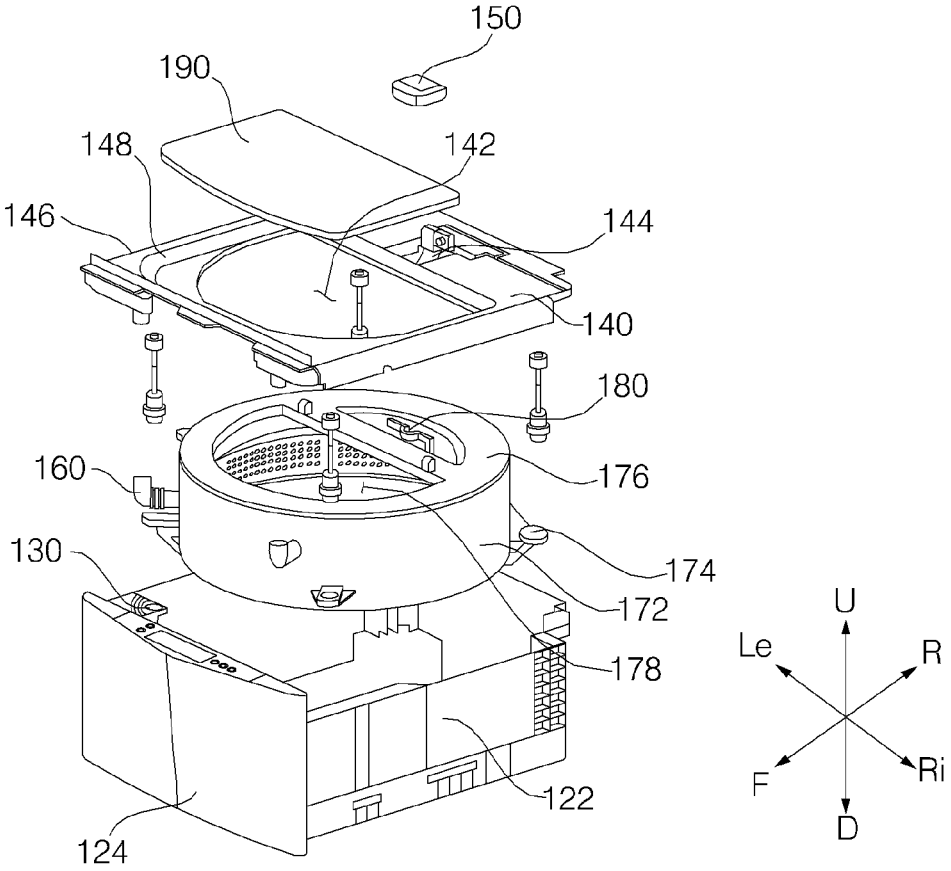
FIG. 5 is an exploded perspective view showing a drawer according to an embodiment of the present invention and elements disposed in the drawer.
Figure 6:
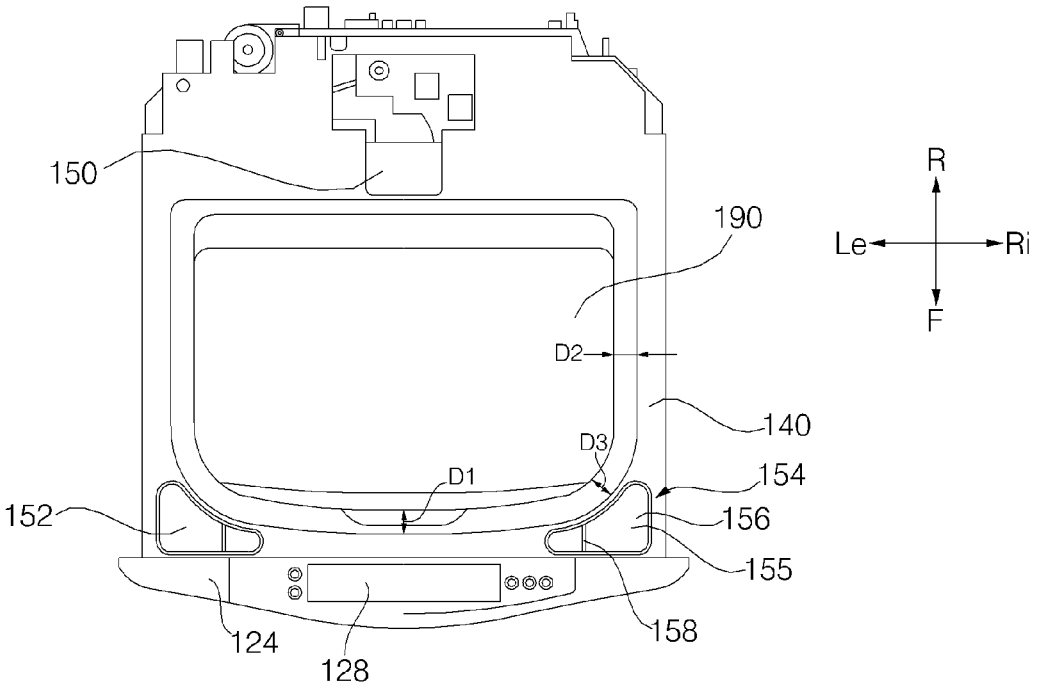
FIG. 6 is a plan view of the drawer according to the embodiment of the present invention.
Figure 7:
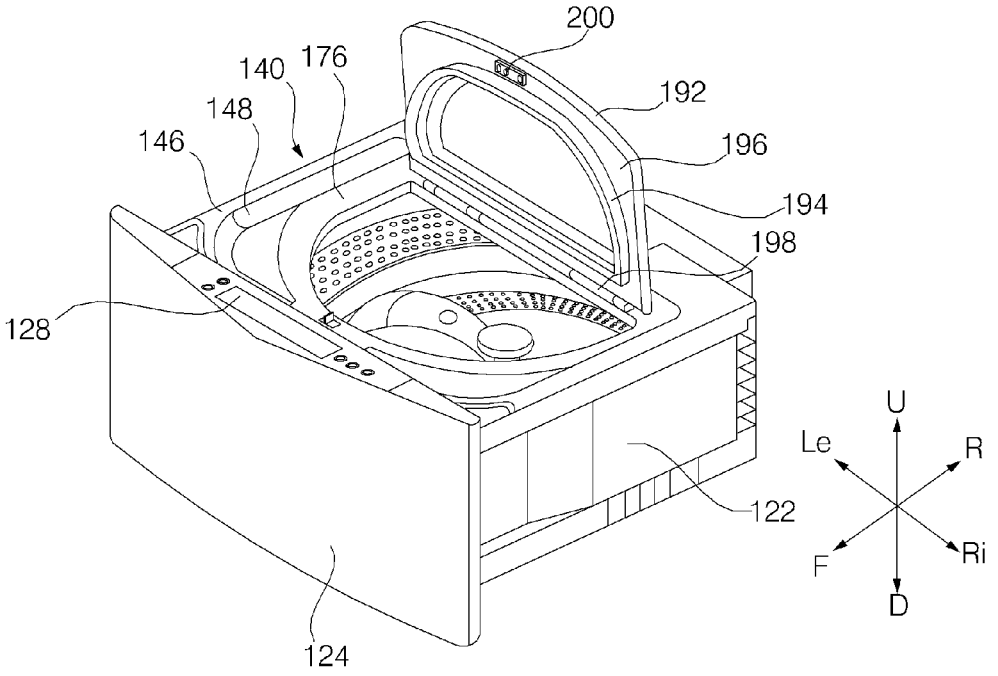
FIG. 7 is a perspective view showing the state in which a door of the drawer according to the embodiment of the present invention is open.

FIG. 2 is a perspective view of a first laundry treatment apparatus according to an embodiment of the present invention. FIG. 3 is a perspective view showing the state in which a drawer of the first laundry treatment apparatus according to the embodiment of the present invention is withdrawn. FIG. 4 is a sectional view of the first laundry treatment apparatus according to the embodiment of the present invention. FIG. 5 is an exploded perspective view showing a drawer according to an embodiment of the present invention and elements disposed in the drawer. FIG. 6 is a plan view of the drawer according to the embodiment of the present invention. FIG. 7 is a perspective view showing the state in which a door of the drawer according to the embodiment of the present invention is open.

Hereinafter, the first laundry treatment apparatus according to the embodiment of the present invention (hereinafter, simply referred to as a "laundry treatment apparatus") will be described with reference to FIGS. 2 to 7.

The first laundry treatment apparatus according to this embodiment includes a cabinet 110, which defines the external appearance thereof, the cabinet 110 being open at one side thereof, a drawer 120 disposed so as to be withdrawn through the open side of the cabinet 110, the drawer 120 being open at the top thereof, a tub 170 disposed in the drawer 120 for defining a space for storing wash water, a drum 210 rotatably disposed in the tub 170, a door 190 for opening and closing the top of the tub 170, which is open, a top cover 140 for covering the open top of the drawer 120, the top cover 140 being disposed along the outer circumference of the door 190 so as to be spaced apart from the door 190 by a predetermined distance, and a shock absorption unit disposed at the tub 170 or disposed so as to be opposite the tub 170 for preventing the top cover 140 from contacting the door 190.

The laundry treatment apparatus 100 according to this embodiment may further include a plurality of suspension members (not shown) disposed between the tub 170 and the drawer 120. One end of each of the suspension members 136 may be connected to the inner upper part of the drawer 120, and the other end of each of the suspension members 136 may be connected to the outer lower part of the tub 170.

The cabinet 110 defines the external appearance of the laundry treatment apparatus. The cabinet 110 has therein a space for receiving the drawer 120. The cabinet 110 may have a box shape that is open at the front thereof.

The cabinet 110 may be provided in the rear surface thereof with a through-hole, through which a portion of a water supply unit 240 or a drainage unit 250 extends. A separate base 126 may be mounted to the bottom of the cabinet 110.

The drawer 120 is disposed so as to be withdrawn through the front open side of the cabinet 110. The drawer 120 may be received in the cabinet 110, or may be disposed such that a portion of the drawer 120 is withdrawn ahead of the cabinet 110.

The drawer 120 has therein a space for receiving the tub 170. The top of the drawer 120 is open. The drawer 120 is disposed so as to be movable along the inner surface of the cabinet 110. The drawer 120 includes a drawer body 122, which defines a space for receiving the tub 170, the drawer body 122 being inserted into the cabinet, and a drawer panel 124 disposed at the front of the drawer body 122 for opening and closing the open front of the cabinet 110.

Inside the drawer body 122 are formed drawer brackets 130, to which the suspension members 136 are connected. The drawer brackets 130 are formed at the inner upper part of the drawer body 122 so as to protrude. In this embodiment, four drawer brackets 130 are disposed at respective inner corners of the drawer body 122. The drawer brackets 130 protrude toward the center of the tub 170.

Each of the drawer brackets 130 is provided with a suspension hole (not shown), which is formed vertically through the drawer bracket 130 such that one end of a corresponding one of the suspension members 136 is inserted into and supported by the drawer bracket 130. Each of the drawer brackets 130 is provided with a recess (not shown), which extends in one direction in order to guide the insertion of each of the suspension members 136 into a corresponding one of the suspension holes 132.

The drawer panel 124 is disposed such that a portion of the drawer panel 124 is opposite the front edge 112 of the cabinet 110. The drawer panel 124 is disposed at the front of the drawer body 122. A portion of the drawer panel 124 may contact the front edge 112 of the cabinet 110 in order to limit the rearward movement of the drawer body 122.

The drawer panel 124 may be provided with a control panel 128 for allowing a control command related to the operation of the laundry treatment apparatus 100 to be input or outputting the operational state of the laundry treatment apparatus 100.

The top cover 140 is disposed at the top of the drawer body 122. The top cover 140 is provided with an entrance 142, through which laundry is introduced and removed. The top cover 140 is disposed along the outer circumference of the door 190, a description of which will follow, so as to be spaced apart from the door 190 by a predetermined distance. When the tub 170 vibrates, the door 190, which is connected to the tub 170, may also vibrate. Since the top cover 140 is disposed along the outer circumference of the door 190 so as to be spaced apart from the door 190 by a predetermined distance, the top cover 140 may not be affected by the vibration of the tub 170. In addition, the top cover 140 may be provided with a water supply through-hole 144, through which one end of the water supply unit 240 extends.

The top cover 140 may be provided in the front thereof with at least one detergent introduction unit 154 for introducing detergent into the tub 170. In this embodiment, detergent introduction units 154 may be provided at opposite sides of the front of the drawer 120, which is adjacent to a user when the drawer 120 is withdrawn from the cabinet 110. The detergent introduction units 154 may be disposed at the front corners of the top cover 140. Each detergent introduction unit 154 includes an introduction bowl 156 formed in the top cover 140 so as to be recessed downwards. An introduction hole 158, through which detergent is introduced into the tub 170, is formed in one side of the introduction bowl 156. The top cover 140 may be formed at the top of the drawer body 122 so as to protrude in order to secure a storage space in the introduction bowl 156.

Each detergent introduction unit 154 is connected to the tub 170 via a detergent introduction pipe 160. Consequently, detergent stored in each detergent introduction unit 154 is supplied into the tub via the detergent introduction pipe 160.

The top cover 140 is provided at the outer edge thereof with fastening ribs, which are fastened to the drawer 120. The top cover 140 is fastened to the drawer panel 124 at the front thereof, and is fastened to the drawer body 122 at the opposite sides and the rear thereof. The side ends and the rear end of the top cover 140 are bent toward the drawer body 122 and are provided with fastening ribs, which are fastened to the drawer body 122.

The top cover 140 covers the remaining portion of the top of the tub 170 excluding the portion of the tub 170 corresponding to the door 190. The top cover 140 includes a top part 146 formed at the top of the drawer 120 so as to be flat and a curved part 148 bent downwards from the top part 146 so as to be concave toward the door 190.

The top part 146 of the top cover 140 is spaced apart from a door panel 192 of the door 190, a description of which will follow, by a predetermined distance. The top part 146 is formed at almost the same height as the door panel 192, and is spaced apart from the door panel 192 by a predetermined distance. The top part 146 of the top cover 140 is formed at almost the same height as the door panel 192 in order to secure a space for temporarily storing detergent to be introduced into the introduction bowl 156 of each detergent introduction unit 154.

The curved part 148 is curved downwards toward the bottom of the door panel 192 and is disposed at the bottom of the door panel 192 so as to cover the top of the tub 170.

The tub 170 defines a space for storing wash water to be used to treat laundry. The tub 170 is disposed in the drawer 120. The tub has a cylindrical shape that is hollow therein and is partially open at the top thereof.

The tub 170 includes a tub body 172, which defines a space for storing water, the tub body 172 being open at the top thereof, and a tub cover 176, which defines the top of the tub body 172.

The tub body 172 has a cylindrical shape that is open at the top thereof. The bottom of the tub body 172 is connected to the drainage unit 250, which drains wash water from the tub 170. At the outer circumference of the tub body 172 are formed tub brackets 174, to which the suspension members 136 are connected.

The tub brackets 174 are disposed at the lower circumferential surface of the tub 170. The tub brackets 174 are disposed so as to correspond to the respective drawer brackets 130. The suspension members 136 are connected to the tub brackets 174 via the drawer brackets 130 of the drawer 120 in order to connect the tub 170 to the drawer 120.

The tub cover 176 is provided with a laundry introduction port 178, through which the inside of the tub body 172 communicates with the outside of the tub body 172. The laundry introduction port 178 may be formed at the lower side of the entrance 142, which is formed in the top cover 140. The tub cover 176 is provided with a water supply port 180, through which water is supplied into the tub body 172. The water supply port 180 may be disposed at the lower side of the water supply through-hole 144, which is formed in the top cover 140.

The door 190, which opens and closes the laundry introduction port 178, is disposed at the upper side of the laundry introduction port 178 of the tub cover 176.

The door 190 is rotatably disposed at the upper side of the tub cover 176. The door 190 is hingedly fixed to the upper side of the tub cover 176. The door 190 may open the laundry introduction port 178 of the tub cover 176 such that the inside of the tub body 172 communicates with the outside of the tub body 172, or may close the laundry introduction port 178 of the tub cover 176 in order to prevent the water in the tub 170 from leaking to the outside.

The door 190 includes a door panel 192 for covering the open top of the tub 170, a sealing member 194 for sealing between the tub 170 and the door 190 when the door 190 closes the laundry introduction port 178 of the tub 170, and a connection member 196 for hingedly fixing the door panel 192 to the tub 170, the sealing member 194 being mounted to one side of the connection member 196. The door 190 may further include a hinge unit 198 disposed at one side of the door panel 192 for hingedly fixing the door panel 192 to one side of the tub cover 176. The hinge unit 198 may be disposed at one side of the rear of the connection member 916.

The door 190 may further include a fixing member 200 for fixing the door 190 to one side of the tub 170 when the door 190 closes the laundry introduction port 178 of the tub 170. The fixing member 200 is disposed in front of the connection member 196. A one-touch click button, which is locked or unlocked by pushing, may be used as the fixing member 200.

The door panel 192 may open and close the laundry introduction port 178 of the tub cover 176. The door panel 192 is formed so as to be larger than the laundry introduction port 178 of the tub cover 176.

The sealing member 194 is disposed at the lower side of the door panel 192. The sealing member 194 forms a seal between the door panel 192 and the tub cover 176 when the door 190 closes the laundry introduction port 178 of the tub cover 176.

The drum 210 is rotatably disposed in the tub 170. The drum 210 has a cylindrical shape that is open at the top thereof. The open top of the drum 210 is disposed at the lower side of the laundry introduction port 178 of the tub 170. The drum 210 may include a balancer 216 for preventing the drum 210 from vibrating excessively due to the eccentricity of laundry when the drum 210 is rotated by a driving unit 220.

The drum 210 is provided in the bottom surface and the circumferential surface thereof with a plurality of communication holes 212, through which the inside of the drum 2109 communicates with the tub 170. The drum 210 is rotated in the tub 1709 by the driving unit 220. The drum 210 is provided on the bottom surface thereof with at least one washing protrusion 214, which protrudes from the bottom surface of the drum 210 to generate a water current during the rotation of the drum 210.

The driving unit 220 includes a stator 222, a rotor 224 configured to be rotated by a rotating field generated by the stator 222, and a rotary shaft 226 for transmitting the rotational force of the rotor 224 to the drum 210.

The laundry treatment apparatus according to this embodiment further includes a water supply unit 240 for supplying water to the tub 170 and a drainage unit 250 for discharging the wash water stored in the tub 170 to the outside.

The water supply unit 240 includes a water supply pipe 242, which is connected to the water supply through-hole 144 in the tub cover 176, and a water supply valve 244 for allowing or interrupting the supply of water to the water supply pipe 242. A portion of the water supply pipe 242 may be formed as a bellows pipe in order to prevent the water supply pipe 242 from being separated from the tub 170 due to the vibration of the tub 170 or such that the length of the water supply pipe 242 is adjustable when the drawer 120 is withdrawn. The top cover 140 may further include a water supply port cover 150 for preventing a portion of the water supply valve 244 from being exposed to the outside when the drawer 120 is withdrawn.

The drainage unit 250 may include a drainage pipe 252 disposed at the lower side of the tub 170 for defining a drainage channel and a drainage pump 254 for pumping the wash water flowing in the drainage channel out of the laundry treatment apparatus 100. The drainage unit 250 may be disposed between the tub 170 and the drawer 120. A portion of the drainage pipe 252 may be formed as a bellows pipe in order to prevent the drainage pipe 252 from being separated from the tub 170 due to the vibration of the tub 170 or such that the length of the drainage pipe 252 is adjustable when the drawer 120 is withdrawn.

Figure 8:
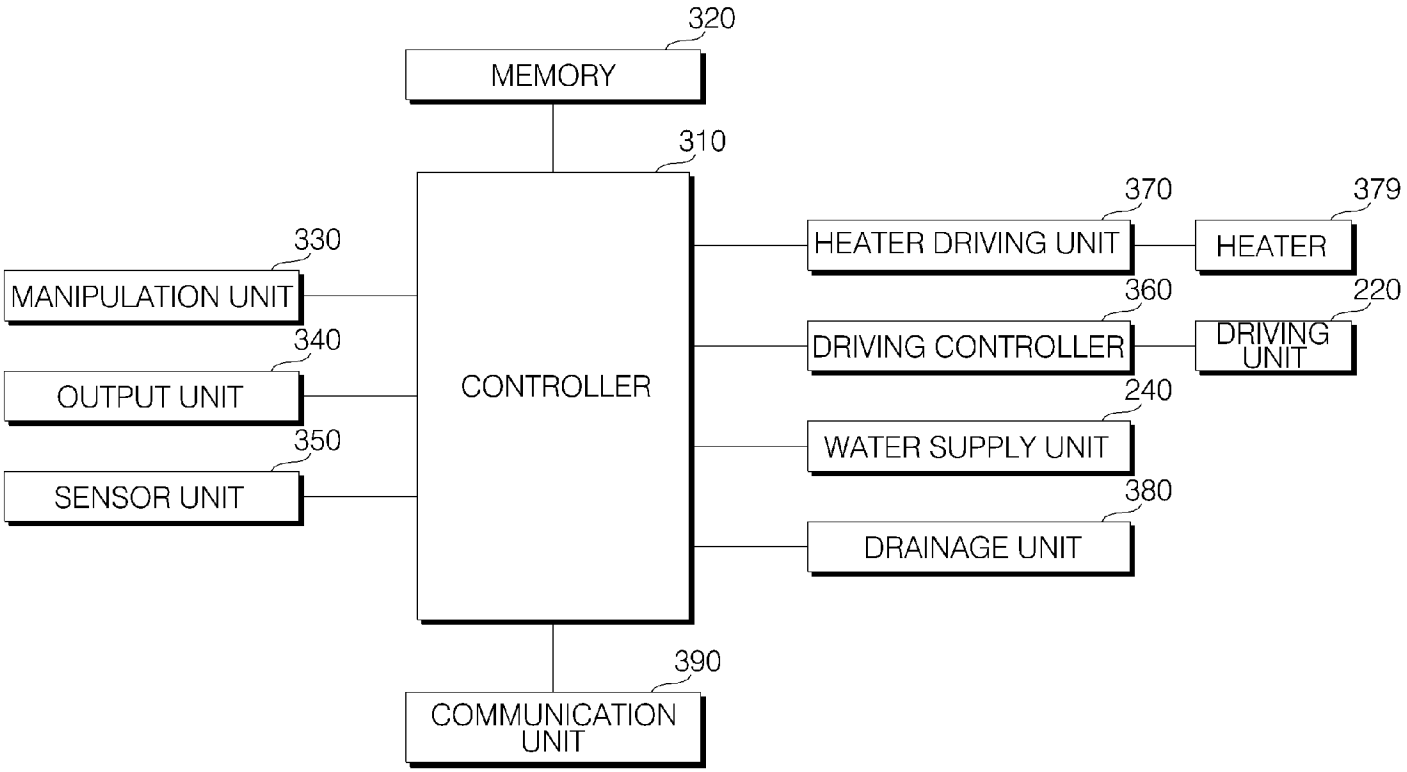
FIG. 8 is a block diagram schematically showing the control construction of the first laundry treatment apparatus according to the embodiment of the present invention.

FIG. 8 is a block diagram schematically showing the control construction of the first laundry treatment apparatus according to the embodiment of the present invention.

As shown in FIG. 8, the first laundry treatment apparatus includes a manipulation unit 330, an output unit 340, a sensor unit 350, a driving controller 360, a water supply unit 240, a drainage unit 380, a heater driving unit 370, a communication unit 390, a memory 320, and a controller 310 for controlling the overall operation thereof.

The manipulation unit 330 includes input means, such as at least one button, a switch, and a touchpad, which are provided at the control panel 128.

The manipulation unit 330 allows operation settings, including power on/off, operation mode, kind of laundry, washing course, water level, and temperature, to be input. When the kind of laundry is selected and the power is turned on through the manipulation unit 330, data regarding the operation settings are input to the controller 310. In the case in which the first laundry treatment apparatus and the second laundry treatment apparatus are installed so as to be adjacent to each other within a predetermined distance or in the case in which the first laundry treatment apparatus and the second laundry treatment apparatus are disposed one on another, the manipulation unit 330 may include a twin washing key (not shown) for allowing the two laundry treatment apparatus to be operated together.

The output unit 340 outputs information about the operation settings and the operational state of the laundry treatment apparatus.

The output unit 340 includes a display for displaying a combination of one of more selected from among letters, numerical icons, images, and special characters on a screen, a lamp for indicating the operational state of the laundry treatment apparatus depending on lighting thereof, and a speaker or a buzzer for outputting a predetermined effect sound or warning sound.

The display may include a menu screen for operation settings and operation control of the laundry treatment apparatus, and may output an announcement message or a warning message including a combination of one or more selected from among letters, numbers, and images for operation settings and operation control of the laundry treatment apparatus.

The output unit 340 may output a warning sound or a warning message when the laundry treatment apparatus is in an abnormal state.

The memory 320 stores control data for operation control of the laundry treatment apparatus, data regarding the input operation settings, data regarding operation time calculated based on settings, data regarding a washing course, and data for determining whether errors have occurred.

In addition, the memory 320 stores data that is generated during the operation of the laundry treatment apparatus or sensed by the sensor unit 350 and data that is transmitted and received through the communication unit 390.

The memory 320 may be a hardware storage device, such as a ROM, a RAM, an EPROM, a flash drive, and a hard drive.

The communication unit 390 transmits and receives data in a wired or wireless fashion.

The communication unit 390 may be connected to a network provided in a building or within a predetermined distance, such as a home network, in order to transmit and receive data. In addition, the communication unit 390 may be connected to an external server, such as the Internet, in order to communicate with a terminal having a control function.

The communication unit 390 may transmit the operational state of the laundry treatment apparatus to a terminal or to another laundry treatment apparatus, and may receive a control command from the terminal or from an external server.

In the case in which the first laundry treatment apparatus and the second laundry treatment apparatus are installed so as to be adjacent to each other within a predetermined distance, the communication unit 390 may transmit and receive data regarding the operation settings or the operational state of the second laundry treatment apparatus to and from the second laundry treatment apparatus such that the laundry treatment apparatuses can be operated together. For example, in the case in which the laundry treatment apparatuses are disposed one on another, the laundry treatment apparatuses may not simultaneously perform operations that generate vibrations based on received data.

The communication unit 390 transmits and receives data using short-distance wireless communication, such as ZigBee, Bluetooth, WiFi, or WiBro.

A power supply unit (not shown) converts commercial power supplied from the outside into operation power and supplies the converted operation power. The power supply unit interrupts the supply of overcurrent. The power supply unit rectifies and smooths power supplied from the outside in order to supply a predetermined operation power.

The sensor unit 350, which includes a plurality of sensors, measures the voltage or current of the laundry treatment apparatus and senses the rotational speed of a motor, a water level, temperature, and humidity. The measured and sensed values are input to the controller 310.

The sensor unit 350 may include a door sensor (not shown), a temperature sensor (not shown), a current sensor (not shown), and a water level sensor. In addition, the sensor unit 350 may further include a speed sensor for sensing the rotational speed of the motor, a humidity sensor, and a laundry sensor for sensing the state/material of laundry.

The temperature sensor senses the temperature in the laundry treatment apparatus and the water temperature. In the case in which a heater is provided, the temperature sensor senses the temperature of the heater. A plurality of temperature sensors may be provided at different positions in order to sense temperature. The water level sensor senses the level of water that is supplied to the tub 170. The current sensor senses current that is supplied to the motor. The door sensor senses whether the door is open or closed. Before the laundry treatment apparatus is operated based on the settings, the door sensor senses whether the door is open or closed, and transmits a sensing signal to the controller 310. In addition, the door sensor may sense whether laundry is caught in the door.

The driving controller 360 performs control such that current is supplied to the driving unit 220 and then the driving unit is rotated. The driving controller 360 converts power supplied from the outside into power necessary to rotate the driving unit 220 in order to control the operation of the driving unit 220. The driving unit 220 is a motor.

The driving controller 360 controls the rotational direction, the rotational angle, and the rotational speed of the driving unit 220 in response to a control command from the controller 310. The driving controller 360 performs control such that the driving unit 220 is operated differently based on the set washing course and on whether washing, rinsing, or spin-drying is to be performed. The driving controller 360 differently controls the rotational direction, the rotational angle, and the rotational speed of the driving unit such that the wash water in the drum generates a water current having a specific form.

The water supply unit 240 controls the opening and closing of the water supply valve 244 and the first valve 371. Based on washing and rinsing cycles, the water supply unit 240 continuously supplies water or supplies water for a predetermined amount of time and then interrupts the supply of water, which is repeatedly performed such that water is intermittently supplied. At the time of final rinsing during the rinsing cycle, the water supply unit 240 controls the first valve such that water is supplied to the first introduction unit 155.

The drainage unit 380 controls the opening and closing of a drainage valve 381 and the operation of a drainage pump 382 such that the water in the tub 170 is discharged to the outside through a drainage hose.

The heater driving unit 370 supplies power to a heater 379 such that the heater is turned on/off and controls the temperature of the heater. The heater 379 generates heat at a predetermined temperature in order to heat the water in the tub.

In addition, during a drying operation, the heater driving unit 370 may control the heater such that laundry is dried using heat generated by the heater. A plurality of heaters, such as a heater for heating wash water and a heater for drying laundry, may be provided.

The heater for heating wash water and the heater for drying laundry may be separately provided. In this case, separate heater driving units may also be provided.

The controller 310 controls a series of washing procedures, including washing, rinsing, spin-drying, and drying. In the following description, the term "washing" refers to all operations of the laundry treatment apparatus, including a washing cycle, a rinsing cycle, a spin-drying cycle, and a drying cycle.

The controller 310 stores the operation settings in the memory 320 and signals a water level, temperature, and control pattern based on a washing course corresponding to the data stored in the memory in order to control the operation of the laundry treatment apparatus.

The controller 310 performs control such that the operation settings or the operational state of the laundry treatment apparatus is output through the output unit 340. In addition, the controller 310 performs control such that data is transmitted to the outside through the communication unit 390 and such that data received from the outside through the communication unit 390 is processed. The controller 310 may change the operation settings such that the laundry treatment apparatus is operated together with another laundry treatment apparatus based on data of the another laundry treatment apparatus received through the communication unit 390.

The controller 310 controls the water supply unit 240 and the drainage unit 380 such that water is supplied to the tub 170 and water is drained from the tub 170 depending on the operation settings, and transmits a control command to the driving controller 360 such that the drum is rotated to perform washing according to the operation of the driving unit. In addition, the controller 310 transmits a control command to the heater (not shown) such that the heater heats wash water or such that a drying cycle is performed.

In addition, while water is supplied up to a predetermined level of the tub 170, the controller 310 controls the water supply unit 240 such that water is directly introduced into the tub or is supplied into the tub through the first introduction unit 155 or the second introduction unit 152 through the opening and closing of the valve.

The water supply unit 240 controls the opening and closing of the water supply valve 244 and the first valve 371 in response to a control command of the controller 310.

The controller 310 may control the water supply unit in order to adjust the flow channel of water that is supplied. The water supply unit directly introduces some of the supplied water into the tub and introduces some of the supplied water into the tub through the first introduction unit 155 such that the additive (detergent or fabric softener) in the first introduction unit is introduced into the tub together with the water.

When the operation settings are input, the controller 310 sets a target water level based on a washing course and sets an operation time based on the washing course and laundry weight. In the case in which the water temperature is set, the controller 310 sets the operation time based on a basic heating time. The controller 310 performs control such that the operation time is displayed through a display of the output unit.

The controller 310 determines whether the heater is driven depending on the operation settings. In the case in which the water temperature is set as cold water based on the operation settings, the controller 310 determines that heating is unnecessary. In addition, the controller 310 determines whether heating is necessary depending on the washing course.

In the case in which water temperature is set, the controller 310 compares the temperature of water sensed by a temperature sensor of the sensor unit 350 during the supply of water with the set water temperature, sets a heating time based on the temperature difference, and resets the operation time in consideration of the heating time.

The controller 310 transmits a control command to the heater driving unit 370 such that the heater is operated based on the temperature difference. The heater driving unit 370 supplies current of a predetermined magnitude to the heater according to the control command such that the heater is operated.

Figure 9:
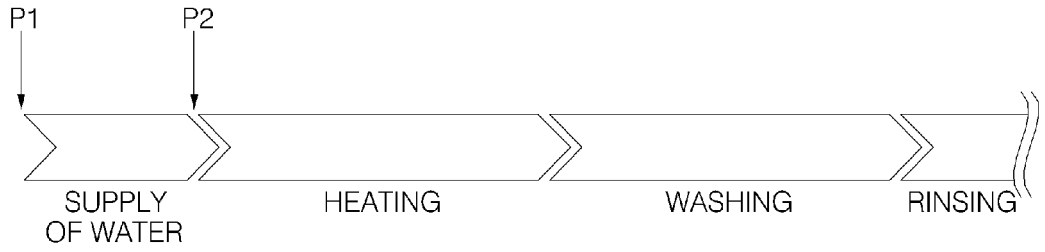
FIG. 9 is a reference view illustrating resetting of the operation time of the first laundry treatment apparatus according to the embodiment of the present invention based on the flow of operation thereof.

FIG. 9 is a reference view illustrating resetting of the operation time of the first laundry treatment apparatus according to the embodiment of the present invention based on the flow of operation thereof.

As shown in FIG. 9, when operation settings are input through the manipulation unit 330, the controller 310 sets a target water level based on the operation settings, i.e. a washing course and water temperature, and calculates an operation time based on the washing course and laundry weight. Since the first laundry treatment apparatus includes a small-sized tub, the water level and the operation time may be set based on the washing course irrespective of the laundry weight.

The controller 310 determines whether heating is necessary based on the washing course and the water temperature. In the case in which it is necessary to heat water, the controller 310 sets an operation time including a basic heating time.

The controller 310 performs control such that the operation time is displayed on the display of the output unit. The controller 310 performs control such that the operation time is primarily displayed before water is supplied.

The controller 310 controls the water supply unit 240 such that water is supplied to the tub 170.

During the supply of water, the temperature sensor of the sensor unit 350 senses the temperature of the water in the tub, and the controller 310 compares the sensed temperature of the water with a predetermined water temperature in order to calculate the temperature difference.

When the supply of water is completed, the controller 310 sets the heating time based on the water level and the temperature difference and resets the operation time in consideration of the heating time. Since the heating time is variable depending on the amount (level) of water and the temperature of water in the case in which the same heater is used, the controller 310 calculates the heating time based on the water level and the temperature difference and resets the operation time.

Since the operation time is reset, it is possible to minimize the difference between the operation time displayed due to the water heating time and the operation time until the actual operation is completed.

The controller 310 performs control such that the reset operation time is displayed on the display of the output unit 340.

The heater driving unit 370 supplies current to the heater 379 in response to a control command from the controller, and the heater generates heat at a predetermined temperature in order to heat water (wash water).

When the temperature of the wash water reaches the predetermined water temperature, the controller 310 transmits a control command to the driving controller 360. As a result, the driving unit 220 is rotated to perform washing.

The laundry treatment apparatus removes contaminants from laundry through washing, rinsing, and spin-drying. The controller 310 performs control such that the spin-dried laundry is dried based on settings.

Figure 10:
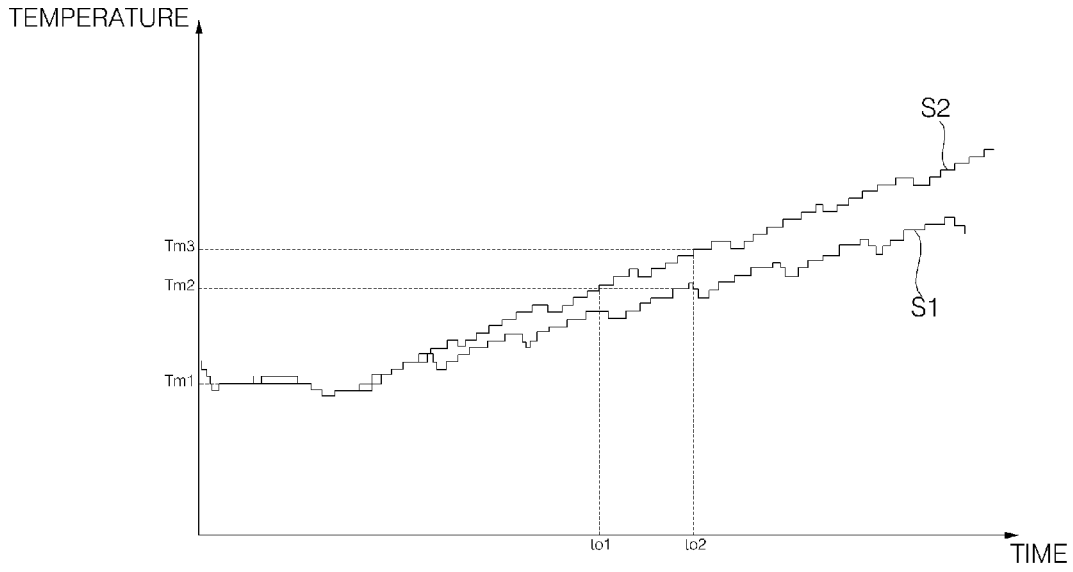
FIG. 10 is a reference view illustrating the wash water heating time of the first laundry treatment apparatus according to the embodiment of the present invention based on the water level thereof.

FIG. 10 is a reference view illustrating the wash water heating time of the first laundry treatment apparatus according to the embodiment of the present invention based on the water level thereof.

As shown in FIG. 10, the water temperature is changed by heating.

The water level is changed depending on a washing course, and the water temperature is changed during heating depending on the water level.

For example, the same target water temperature and different target water levels are set for course A (S1) and course B (S2). Course B (S2) is a course for washing a small amount of laundry. The target water level of course B (S2) is set so as to be lower than that of course A (S1). In the case in which course A and course B are controlled in the state of having the same initial water temperature, i.e. a first temperature Tm1, when water is heated using the same heater 379 after the supply of water, course A and course B have the same initial water temperature and the target water temperature. Since the water levels of course A and course B are different from each other, however, the rate of change in the water temperature of course A is different from that of the water temperature of course B.

At a first time t01, the sensed water temperature of course A is a second temperature Tm2, and the sensed water temperature of course B is a third temperature Tm3.

In addition, course A has the second temperature Tm2 at the first time t01, whereas course B has the second temperature Tm2 at a second time t02.

Consequently, the controller 310 calculates the heating time based on the water level and the difference between the sensed water temperature and the target water temperature in order to reset the operation time. The water level may be variable depending on the washing course or laundry weight.

The controller 310 may divide the water level into a plurality of water levels, and may designate different temperature change rates for the respective water levels in order to calculate the heating time. For example, the controller 310 designates a temperature change rate according to a first condition for a water level lower than a first water level in order to calculate the heating time, and designates a temperature change rate according to a second condition for a water level equal to or higher than the first water level in order to calculate the heating time.

The first level may be set to be the average of target water levels set for respective courses.

For example, the controller 310 may calculate the heating time under a condition in which the water temperature is changed by 0.6° C. per minute for a water level equal to or higher than the first water level, and may calculate the heating time under a condition in which the water temperature is changed by 1° C. per minute for a water level lower than the first water level.

Figure 11:
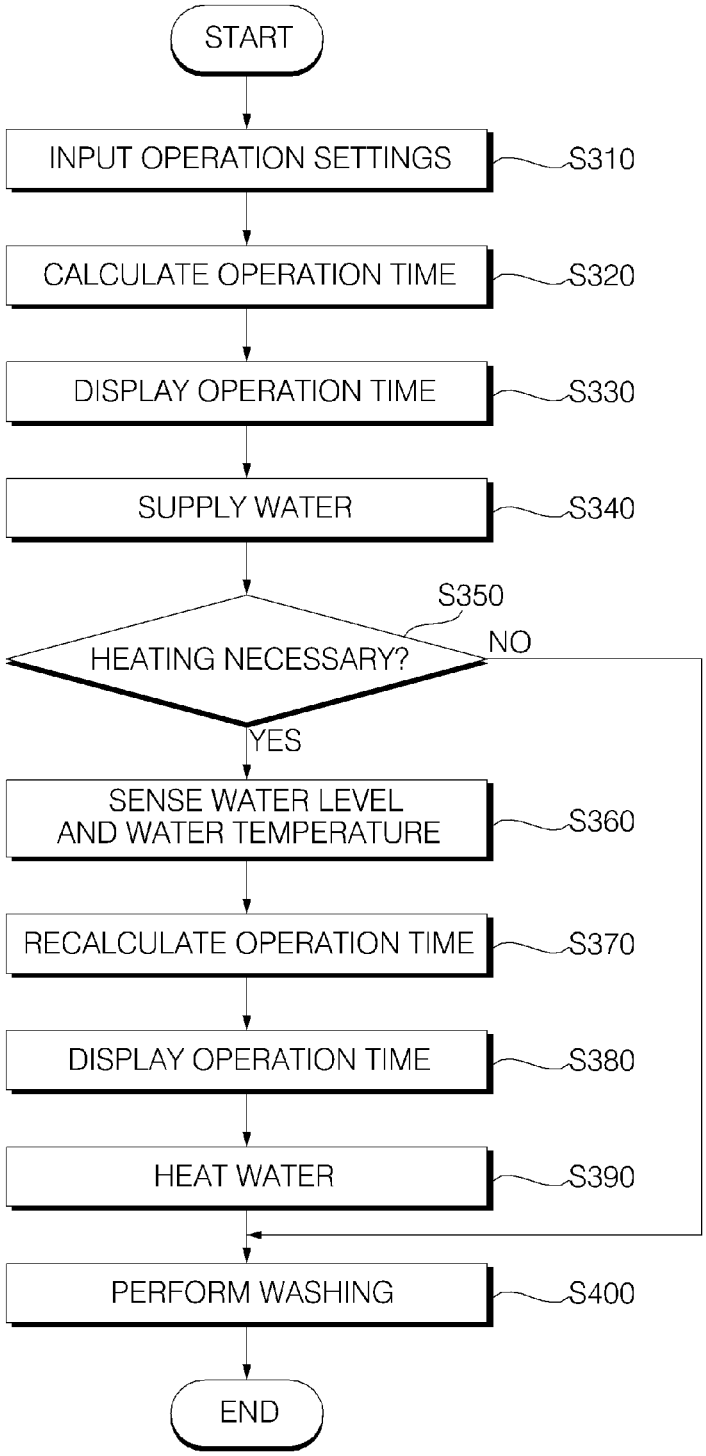
FIG. 11 is a flowchart showing a control method of the first laundry treatment apparatus according to the embodiment of the present invention.

FIG. 11 is a flowchart showing a control method of the first laundry treatment apparatus according to the embodiment of the present invention.

As shown in FIG. 11, when operation settings are input through the manipulation unit 330 (S310), the controller 310 calculates an operation time based on a washing course and on whether heating is necessary (S320).

In the case in which heating is necessary depending the washing course and water temperature setting, the controller calculates an operation time including a predetermined basic heating time. The controller may sense laundry weight, and may calculate the operation time based on the sensed laundry weight. Since the first laundry treatment apparatus includes a small-sized tub having a capacity smaller than a predetermined capacity, however, the water level may be set based on the washing course.

The controller 310 transmits the calculated operation time to the output unit 340, and the display outputs the operation time (S330).

The controller 310 controls the water supply unit 240 such that the water supply valve is open to supply water to the tub (S340).

The controller 310 determines whether heating is necessary depending on the operation settings (S350).

In the case in which the water temperature is set as cold water or in the case in which hot water is not necessary depending on the washing course, the controller 310 determines that heating is unnecessary, and controls the driving controller 360 such that washing is performed when the supply of water is completed without resetting the operation time (S400).

Also, in the case in which the temperature of the supplied water and the target water temperature are the same within a predetermined error range, the controller 310 may determine that heating is unnecessary.

Meanwhile, in the case in which heating is necessary, the temperature sensor of the sensor unit 350 senses the temperature of the water in the tub, and the water level sensor senses the level of the water in the tub (S360).

The controller 310 compares the sensed water temperature with the target water temperature based on the operation settings in order to calculate the temperature difference and sets a condition according to the temperature change rate depending on the water level to calculate the heating time. The controller recalculates the operation time in consideration of the calculated heating time (S370). The controller 310 calculates the heating time based on the target water level that is set depending on the washing course.

For example, in the case in which the temperature difference is 10° C., the water level is equal to or lower than the reference water level, and the temperature is increased by 1° C. per minute, the controller 310 sets the heating time to 10 minutes and recalculates the operation time.

The controller 310 transmits the recalculated operation time to the output unit 340, and the display outputs the changed operation time (S380).

The heater driving unit 270 drives the heater 379 in response to a control command from the controller 310 such that the water in the tub is heated by the heat generated from the heater (S390). The heater driving unit 270 may start heating before the supply of water is completed.

When the water temperature reaches the target water temperature, the driving controller 360 controls the driving unit 220 according to the control command of the controller such that the driving unit 220 is rotated to perform washing (S400).

Figure 12:
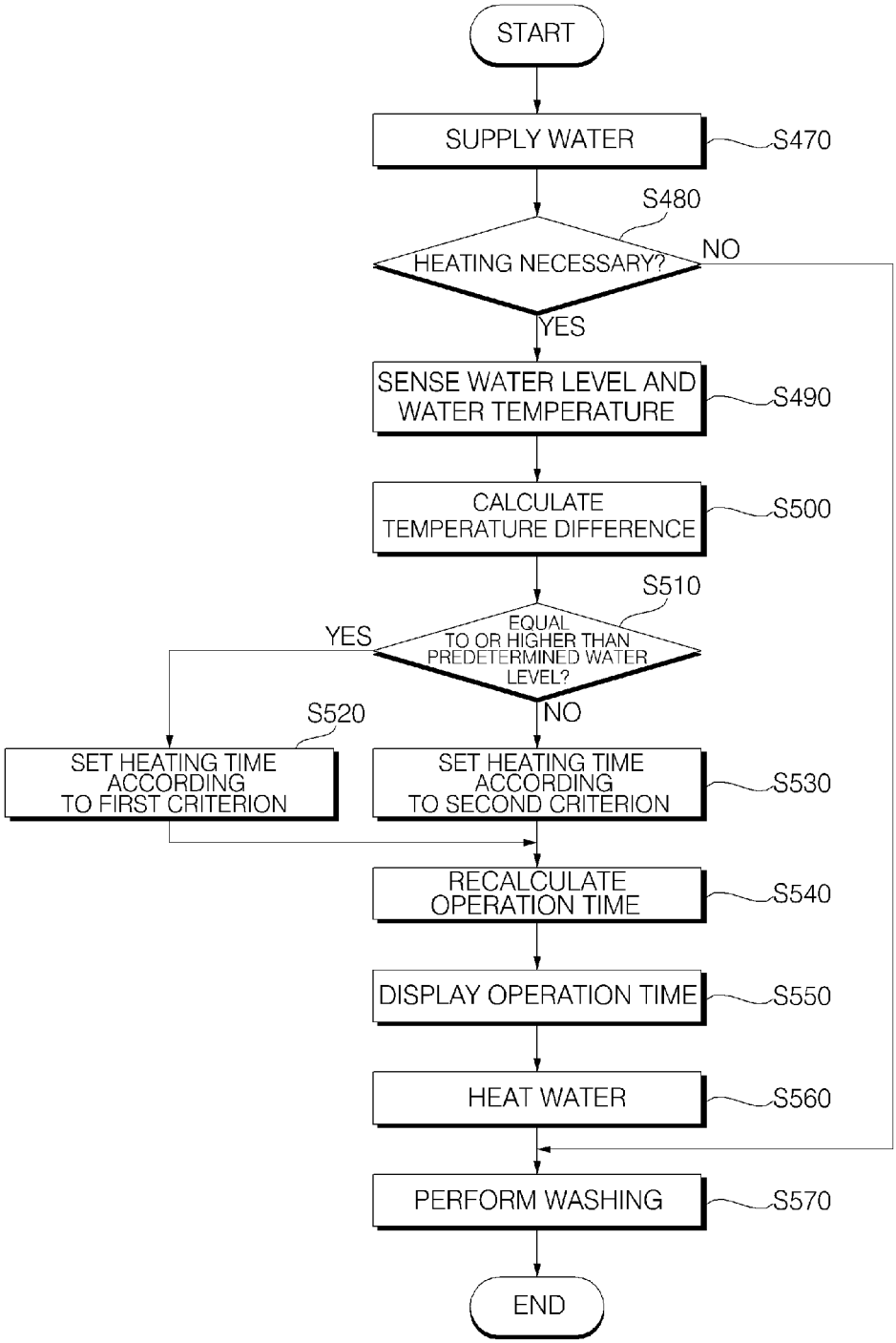
FIG. 12 is a flowchart showing an operation time resetting method of the first laundry treatment apparatus according to the embodiment of the present invention.

FIG. 12 is a flowchart showing an operation time resetting method of the first laundry treatment apparatus according to the embodiment of the present invention.

As shown in FIG. 12, the water supply unit 240 controls the water supply valve 244 such that water is introduced into the tub 170 (S470).

The controller 310 determines whether heating is necessary (S480). In the case in which heating is unnecessary, washing is performed without heating when the supply of water is completed (S570).

In the case in which the water temperature is set as cold water depending on the operation settings or in the case in which hot water is not necessary depending on the selected washing course, the controller 310 determines that heating is unnecessary.

The temperature sensor of the sensor unit 350 senses the temperature of the water that is introduced into the tub 170, and the water level sensor senses the level of the water that is introduced into the tub 170 (S490).

The sensor unit 350 compares the sensed water temperature with the water temperature based on the operation settings to calculate the temperature difference (S500).

The controller 310 determines whether the water level is equal to or higher than a predetermined water level (S510).

During the supply of water, the controller 310 may determine whether the target water level set depending on the washing course is equal to or higher than the predetermined water level. In addition, the controller 310 may compare the water level sensed by the water level sensor when the supply of water is completed with the predetermined water level.

The water level sensed by the water level sensor may be represented by a frequency value. When the water level increases, the frequency value decreases.

In the case in which the water level exceeds the predetermined water level, the controller 310 sets the heating time according to a first criterion based on the change in water temperature during heating (S520). Also, in the case in which the water level is equal to or lower than the predetermined water level, the controller 310 sets the heating time according to a second criterion based on the change in water temperature (S530).

For example, in the case of full-tub washing, which is operated at the full water level, the heating time may be set based on the first criterion, and in the case of washing a small amount of laundry, such as washing of underwear or baby clothes, in which washing is performed at a low water level, the heating time may be set based on the second criterion. In the case in which the temperature difference is 10° C. and the water level is equal to or lower than the predetermined water level, the heating time may be calculated such that the water temperature is increased by 1° C. per minute. In the case in which the temperature difference is 10° C. and the water level is higher than the predetermined water level, the heating time may be calculated such that the water temperature is increased by 0.6° C. per minute.

The controller 310 recalculates the operation time based on the heating time (S540).

The controller 310 transmits the operation time to the output unit 340, and the display outputs the operation time.

The controller 310 transmits a control command to the heater driving unit such that water is heated, and transmits a control command to the driving controller such that washing is performed.

The heater driving unit 370 drives the heater 379 in response to the control command from the controller 310 such that the water in the tub is heated by the heater (S560). The driving controller 360 rotates the driving unit 220 in response to the control command from the controller 310. As a result, the drum is rotated in alternating directions to perform washing (S570).

In the present invention, therefore, the heating time is calculated differently depending on the washing course or the water level, and operation time is reset. Consequently, it is possible to display an operation time that is near the actual operation time.

As is apparent from the above description, it is possible for a laundry treatment apparatus according to the present invention and a control method thereof to determine whether to heat wash water based on the difference between a set temperature and the temperature of water that is supplied.

When the wash water is to be heated, it is possible to calculate time necessary to heat the wash water, to reset an operation time, and to display the reset operation time.

In addition, it is possible to more accurately calculate the operation time based on the operation time that is changed depending on whether it is necessary to heat the wash water.

In addition, it is possible to complete all operations based on the set operation time, since the operation time is accurately calculated.

In addition, it is possible to prevent a user from repeatedly accessing the laundry treatment apparatus in order to remove laundry from the laundry treatment apparatus due to non-completion of washing.

Although an exemplary embodiment of the present invention has been described with reference to a number of illustrative embodiments thereof, it should be understood that numerous other modifications and embodiments can be devised by those skilled in the art that will fall within the sprit and scope of the principles of the invention.

What is claimed is:

1. A laundry treatment apparatus comprising:

a tub that defines a space therein configured to store wash water;

a drum rotatably disposed in the tub;

a heater configured to heat wash water in the tub;

a temperature sensor configured to sense a temperature of wash water;

a water level sensor configured to sense a level of wash water;

an output unit configured to display at least one operation setting of the laundry treatment apparatus; and a controller configured to:

primarily calculate an operation time based on the at least one operation setting;

output the primarily calculated operation time through the output unit;

recalculate the operation time based on a state of supplied wash water to the tub;

output the recalculated operation time through the output unit based on completion of supplying wash water to the tub, wherein the state of supplied wash water to the tub includes the temperature of wash water sensed by the temperature sensor while supplying wash water to the tub and the level of wash water supplied to the tub sensed by the water level sensor, and wherein the operation time is a set time for operating a washing course according to the at least one operation setting, wherein the controller is further configured to:

determine the level of wash water among a plurality of water levels, the plurality of water levels corresponding to a plurality of temperature change rates, calculate a heating time based on a temperature change rate corresponding to the level of wash water determined among the plurality of water levels, and recalculate the operation time by including the heating time in the operation time.

2. The laundry treatment apparatus according to claim 1, wherein the controller is further configured to:

calculate a temperature difference between the temperature of wash water sensed by the temperature sensor and a target water temperature corresponding the at least one operation setting; and calculate the heating time based on the temperature difference.

3. The laundry treatment apparatus according to claim 1, wherein the controller is further configured to:

based on a determination that the level of wash water is higher than a predetermined water level, calculate the heating time according to a first temperature change rate; and based on a determination that the level of wash water is lower than or equal to the predetermined water level, calculate the heating time according to a second temperature change rate.

4. The laundry treatment apparatus according to claim 1, wherein the controller is further configured to calculate the heating time based on a target water level of the washing course according to the at least one operation setting.

5. The laundry treatment apparatus according to claim 1, further comprising:

wherein the controller is further configured to calculate the heating time based on a change rate of the level of wash water sensed by the water level sensor.

6. The laundry treatment apparatus according to claim 1, wherein the controller is further configured to primarily calculate the operation time based on (i) the washing course according to the at least one operation setting and (ii) a predetermined heating time.

7. The laundry treatment apparatus according to claim 1, wherein the controller is further configured to:

determine that heating is unnecessary, and perform the washing course according to the at least one operation setting after completion of supply of water in any case of:

the washing course corresponding to a washing course using cold water, the temperature of wash water being equal to a target water temperature, or a water temperature difference between the temperature of wash water and the target water temperature being within an error range.

8. The laundry treatment apparatus according to claim 1, wherein the output unit is configured to:

output the primarily calculated operation time based on an input of the at least one operation setting in response to a control command of the controller.

9. The laundry treatment apparatus according to claim 1, wherein the output unit comprises a display, and wherein the display is configured to output at least one of information about the temperature of wash water, the level of wash water, the primarily calculated operation time, and the recalculated operation time.

10. The laundry treatment apparatus according to claim 1, wherein the controller is further configured to determine the temperature change rate among the plurality of temperature change rates.

11. The laundry treatment apparatus according to claim 1, wherein the plurality of water levels comprise a first water level corresponding to an average of target water levels of a plurality of washing courses.

12. The laundry treatment apparatus according to claim 1, wherein the plurality of temperature change rates comprise (i) a first temperature change rate corresponding to a water level less than a reference water level and (ii) a second temperature change rate corresponding to a water level greater than or equal to the reference water level.

13. The laundry treatment apparatus according to claim 12, wherein the reference water level is an average of target water levels of a plurality of washing courses.

* * * * *